US006089040A

United States Patent [19]

Guillard

[11] Patent Number: 6,089,040

[45] Date of Patent: Jul. 18, 2000

[54] COMBINED PLANT OF A FURNACE AND AN AIR DISTILLATION DEVICE AND IMPLEMENTATION PROCESS

[75] Inventor: Alain Guillard, Paris, France

[73] Assignee: L'Air Liquide, Societe Anonyme pour l'Etude et l'Exploitation des Procedes Georges Claude, Paris Cedex, France

[21] Appl. No.: 09/235,837

[22] Filed: Jan. 22, 1999

[30] Foreign Application Priority Data

Jan. 23, 1998 [FR] France ..... 98 00722

[51] Int. Cl.[7] ..... F25J 1/00

[52] U.S. Cl. ..... 62/646; 62/915

[58] Field of Search ..... 62/643, 646, 915

[56] References Cited

U.S. PATENT DOCUMENTS 4,022,030 5/1977 Brugerolle .
5,244,489 9/1993 Grenier .
5,317,862 6/1994 Rathbone ..... 62/915
5,582,036 12/1996 Drnevich et al. ..... 62/915

FOREIGN PATENT DOCUMENTS 0 531 182 3/1993 European Pat. Off. .
0 636 845 2/1995 European Pat. Off. .
0 717 249 6/1996 European Pat. Off. .

*Primary Examiner*—Ronald Capossela
*Attorney, Agent, or Firm*—Young & Thompson

[57] ABSTRACT

The combined plant comprises at least one furnace (F), at least one air distillation device containing at least one medium-pressure column (MP) and a mixing column (CM) which has an oxygen outlet line (O) for supply to the furnace (F), at least one blowing engine (S) which feeds at least the furnace (F) and the medium-pressure column (MP), and at least one air compressor (C) which supplies at least the mixing column (CM) with air at a pressure which is greater than the pressure of the air supplied by the blowing engine (S).

16 Claims, 2 Drawing Sheets

COMBINED PLANT OF A FURNACE AND AN AIR DISTILLATION DEVICE AND IMPLEMENTATION PROCESS

FIELD OF THE INVENTION

The present invention relates to combined plants comprising at least one furnace, typically a metal-processing furnace, fed with compressed air, and of at least one device for distilling air which produces oxygen to enrich the air supplied to the furnace, as well as to processes for implementing such combined plants.

BACKGROUND OF THE INVENTION

To enrich a flow of air with oxygen, the production of high-purity oxygen is not required and the use of a distillation device containing a mixing column as described in document U.S. Pat. No. 4,022,0310 (Brugerolle) is suitable. Combined plants of a blast furnace and an air distillation device which comprises such a mixing column are described, for example, in the documents U.S. Pat. No. 5,244,489 (Grenier) and EP-A-0,531,182, in the name of the Applicant. However, the approaches followed in these two documents are at variance: in document U.S. Pat. No. 5,244,489, the distillation device is entirely fed with air via a diversion of the blast from a blast furnace blowing engine and the part of the flow of air supplied to the mixing column is given a slight positive pressure by means of a blower driven by a cold-temperature-maintenance turbine which depressurizes the part of the flow of air directed to the medium-pressure column, in an arrangement which makes it necessary, in order to achieve the said positive pressure, to turbine a large part of the air fed to the medium-pressure column, giving rise to losses of extraction yield and of energy, as well as oversizing of the stations for refrigerating and purifying the air fed to the distillation device. In contrast, document EP-A-0,531,182 envisages a complete separation of the air supplies a) for the blast furnace, b) for the medium-pressure column and c) for the mixing column, using separate compression means in order, in particular, to allow the production, in the mixing column, of impure oxygen at high or low pressures, in an arrangement which is expensive in terms of the investment in and running of rotating machines and which does not envisage any synergy between these machines.

SUMMARY OF THE INVENTION

The aim of the present invention is to propose a combined plant and a process for using such a combined plant with very complete integration and which allows substantial reductions in running costs while at the same time offering flexibility in the selection of the operating ranges.

To do this, according to one characteristic of the invention, the process for using a combined plant is of the type comprising at least one furnace fed with air by at least one blowing engine which supplies air at a first pressure $P_1$, and with oxygen by at least one air distillation device comprising at least one medium-pressure column which is at least partially fed with air by the furnace blowing engine, and a mixing column which supplies oxygen to the furnace, and in which the mixing column is fed with air by a compressor which supplies air at a pressure $P_2$ which is greater than $P_1$.

According to a specific characteristic of the invention, the medium-pressure column is fed solely with compressed air supplied by the furnace blowing engine.

According to another characteristic of the invention, the medium-pressure column is also fed with compressed air supplied by at least one compressor stage on the same branch line as the compressor which supplies the mixing column.

The subject of the present invention is also a combined plant comprising at least one furnace, at least one blowing engine which delivers into a main compressed air line connected to the furnace, at least one air distillation device containing at least one medium-pressure column and a mixing column having an oxygen outlet line which opens into a downstream part of the main compressed air line, a diversion line from the main compressed air line supplying air to at least the medium-pressure column, and at least one air compressor supplying pressurized air to at least the mixing column.

According to the invention, the distillation device uses some of the flow of air from the blowing engine which is divertable on account of the subsequent re-injection of oxygen into this flow of air, while at the same time making the best use of the possibilities offered by the mixing column, by selecting by the choice of the compressor—and of the inter-column liquid pump—the optimum oxygen pressure for re-injection into the blast from the blowing engine.

BRIEF DESCRIPTION OF THE DRAWINGS

Other characteristics and advantages of the present invention will emerge from the following description of the embodiments, given for illustrative but in no way limiting purposes, in relation with the attached drawings, in which.

DETAILED DESCRIPTION OF THE INVENTION

Figure 1:
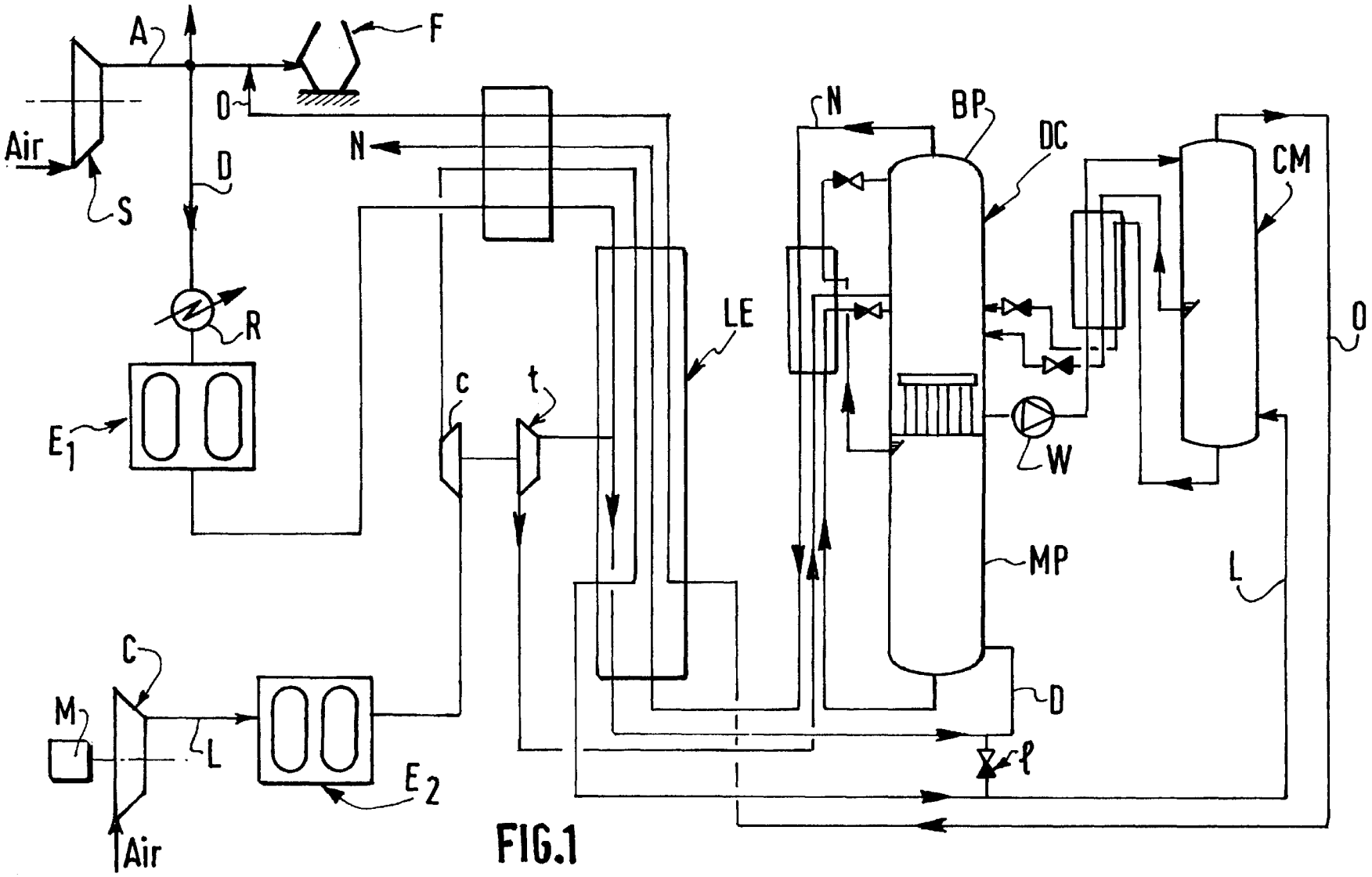
FIGS. 1 and 2 are two embodiments of a combined plant according to the invention.

In the description which follows and in the drawings, the identical or similar components bear the same reference numbers, where indicated.

The figures diagrammatically represent a metal-processing furnace, in this case a blast furnace F, and an associated air distillation device essentially comprising, in the examples represented, a main exchange line LE, a double column DC with a medium-pressure column MP and a low-pressure column BP, and a mixing column CM.

The furnace F is fed with air by a blowing engine S which delivers, into a main compressed air line A, a large volume of air (typically greater than 100,000 $Nm^3/h$) at a medium pressure $P_1$ which does not exceed $5.8\times10^5$ Pa, typically between $3\times10^5$ Pa and $5.5\times10^5$ Pa. The line A can also feed, simultaneously or alternately, another metal-processing furnace, for example an electric furnace, with the AOD process.

According to the invention, the medium-pressure column MP is fed, at the bottom, with air which is essentially at the pressure $P_1$ supplied by the blowing engine S by means of a line D derived from the main line A and successively crossing a cooling device R, a purification device $E_1$, typically of the adsorption type, and then the main exchange line LE. The mixing column CM is, for its part, fed at the bottom, with air at a pressure $P_2$ via a line L fed with air pressurized by a dedicated compressor C driven by a motor M, the air supplied by this compressor C being purified in a second purification device $E_2$, also typically of the adsorption type, before crossing the exchange line LE.

Conventionally, a line N of medium-purity nitrogen gas leaves from the top of the low-pressure column BP and a line O of medium-purity oxygen leaves from the top of the mixing column CM and, according to the invention, after crossing the exchange line LE, opens into the main compressed air line A upstream of the furnace F to enrich with oxygen the air supplied to this furnace. A pump W compresses the liquid oxygen taken from the bottom of the low-pressure column BP and conveyed to the top of the mixing column CM essentially at the pressure $P_2$ of the air introduced via the line L into the mixing column CM.

The pressure $P_2$ is chosen to be slightly greater than the pressure $P_1$ in the line A in order to take account of the losses of pressure in the air distillation device, in the warm air/oxygen mixing devices downstream of the line A and to optimize the regulation of this oxygen injection. Typically $P_2-P_1$ is between $0.3\times10^5$ Pa and $4\times10^5$ Pa, advantageously between $0.5\times10^5$ Pa and $1.5\times10^5$ Pa.

In the embodiment in FIG. 1, some of the flow of air in the line D is diverted towards the low-pressure column BP by being turbined in a turbine t which serves in particular to keep the device cold. The motor M driving the compressor C which feeds the mixing column CM is, for example, an electric motor which advantageously uses the electrical energy produced onsite by a co-generation plant, or a turbine which uses a pressurized fluid available on-site. The turbine t is advantageously coupled to a blower c to give a positive pressure to a compressed fluid from the plant, typically the flow of purified air in the line L, in order to optimize the investment for the dedicated compressor C and/or the power supplied by the motor M. Also advantageously, in order to attenuate the consequences of any variations in flow available from the blowing engine S, a line 1 is provided, which is fitted with a depressurization member, between the downstream parts of the lines D and L in order to direct, at least temporarily, some of the flow in the line L towards the medium-pressure column MP, thus complementing the flow taken from the blowing engine line A.

Figure 2:
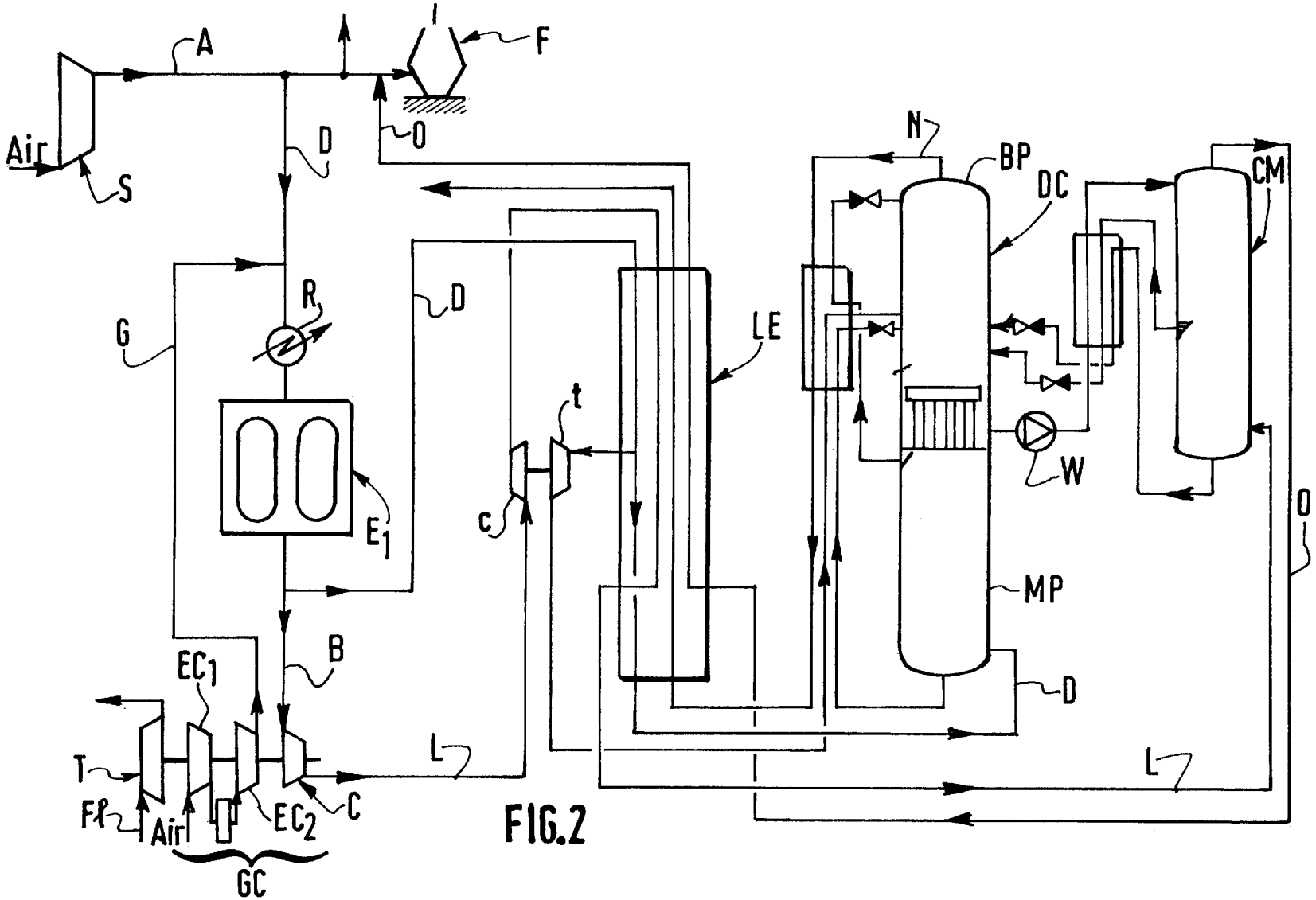

In the embodiment in FIG. 2, the compressor C which delivers into the line L compresses a flow of air derived, in a diversion line B, from the line D feeding the medium-pressure column MP, downstream of the purification device $E_1$. To compensate for the flow of air thus taken from the line D, an additional flow of air, which is essentially at the pressure $P_1$, is introduced into this line D, upstream of the cooling device R, via a line G originating from an upstream stage (in this case the second stage $EC_2$) of a line of compressors GC on the same branch line on which is mounted the compressor C which feeds the mixing column CM. As represented in FIG. 2, the compressor line $EC_1$–C is advantageously driven by a turbine T which depressurizes a pressurized fluid $F_1$ available on-site, typically steam.

In the embodiment in FIG. 2, since the compressor C outlet pressure can be chosen to be greater than the pressure $P_2$ required for the mixing column, the air leaving this compressor C can be turbined up to the pressure $P_2$ in the turbine t which can thus be used to drive a blower c which serves to give a positive pressure to one of the fluids entering or leaving the distillation device, for example, as represented in FIG. 2, the impure nitrogen in the line N in order to help upgrade this impure nitrogen, for example by introducing it as ballast in the combustion chamber of a gas turbine group using a combustible gas transformed from a residual gas from the furnace F.

Although the present invention has been described in relation to specific embodiments, it is not limited thereto but is, rather, capable of being subject to modifications and variants which will become apparent to those skilled in the art and which remain within the context of the claims below.

What is claimed is:

1. Process for operating a combined plant comprising at least one furnace and an air separation apparatus comprised of a distillation column including a medium-pressure column, and a mixing column, the method comprising:

compressing a feed flow of air from a blowing engine to a first pressure $P_1$;

dividing the feed flow into a first flow and a second flow;

sending said first flow at said first pressure to the blast furnace;

sending said second flow at said first pressure to the medium-pressure column;

providing a compressor which supplies a stream of air at a second pressure $P_2$, which is greater than the first pressure;

sending said stream of air at said second pressure to said mixing column to generate a stream of oxygen; and feeding said stream of oxygen to said furnace.

2. Process according to claim 1, wherein the first pressure $P_1$ does not exceed $5.8\times10^5$ Pa.

3. Process according to claim 1, wherein $P_2-P_1$ is greater than $0.3\times10^5$ Pa.

4. Process according to claim 3, wherein $P_2-P_1$ does not exceed $4\times10^5$ Pa.

5. Process according to claim 1, wherein the medium-pressure column is fed solely with compressed air supplied by the blowing engine.

6. Process according to claim 1, wherein the medium-pressure column is also fed with compressed air supplied by at least one compressor stage in the same branch line as said compressor.

7. Process according to claim 6, wherein the compressor also compresses a flow of air derived from the second flow feeding the medium-pressure column.

8. Process according to claim 1, wherein the compressor is driven by depressurization of at least one pressurized fluid which is available on-site.

9. Process according to claim 1, wherein a portion of the stream of air at the second pressure $P_2$ is depressurized and directed to the medium-pressure column.

10. A plant comprising:

at least one furnace and an air separation apparatus comprised of a distillation column including a medium-pressure column, and a mixing column;

at least one blowing engine structured and arranged to deliver air at a first pressure into a main compressed air line connected to the furnace;

a diversion line from the main compressed air line for supplying air at said first pressure to the medium-pressure column;

the medium pressure column having a fluid transfer line connected to the mixing column;

at least one air compressor structured and arranged to supply air at a second pressure greater than said first pressure to at least the mixing column; and the mixing column having a gaseous oxygen outlet which is fluidly connected to the main compressed air line.

11. Plant according to claim 10, further comprising an air purification device positioned in an upstream part of the diversion line.

12. Plant according to claim 11, further comprising an additional air purification device between the air compressor and the mixing column.

13. Plant according to claim 11, wherein the air compressor is located in a branch of the diversion line.

14. Plant according to claim 13, wherein the plant comprises a compression group fed with ambient air and comprising at least one upstream stage and a final stage on the same branch line; the final stage constituting the air compressor and the upstream stage having an outlet connected to the diversion line upstream of the air purification device.

15. Plant according to claim 11, wherein the air compressor is driven by a turbine located in a line of pressurized fluid.

16. Plant according to claim 10, wherein the air compressor is fed with ambient air.

* * * * *